United States Patent [19]

Miyakawa et al.

[11] 4,006,709

[45] Feb. 8, 1977

[54] DEVELOPING UNIT FOR ELECTROPHOTOGRAPHY

[75] Inventors: Seiichi Miyakawa, Nagareyama; Toyoo Okamoto, Yokohama, both of Japan

[73] Assignee: Ricoh Co., Ltd., Japan

[22] Filed: Dec. 15, 1975

[21] Appl. No.: 640,846

[30] Foreign Application Priority Data

Dec. 24, 1974 Japan ..... 49-3293

[52] U.S. Cl. ..... 118/648; 118/DIG. 23; 427/15

[51] Int. Cl.[2] ..... G03G 13/10

[58] Field of Search ..... 118/637, DIG. 23; 355/3, 10; 427/13, 15

[56] References Cited

UNITED STATES PATENTS

| | | | |
|---|---|---|---|
| 3,719,169 | 3/1973 | Cade et al. | 118/637 |
| 3,784,397 | 1/1974 | Sato et al. | 427/13 |
| 3,831,556 | 8/1974 | Sato et al. | 118/637 |
| 3,857,549 | 12/1974 | Snelling | 355/3 |

*Primary Examiner*—Henry S. Jaudon
*Attorney, Agent, or Firm*—McGlew and Tuttle

[57] ABSTRACT

The unit comprises a plurality of detection electrodes disposed adjacent developing electrodes for sensing respective instantaneous potentials of portions of an electrostatic latent image carried on a rotating photosensitive drum so as to produce respective output signals. A potential source responsive to the signals applies a potential slightly higher than the lowermost one of the sensed potentials to the developing electrodes. A protective electrode plate has a plurality of apertures for disposition of respective detection electrodes therein, and has applied thereto a potential near those appearing on the detection electrodes, thereby cutting off the influence of external electrical fields upon the detection electrodes.

5 Claims, 2 Drawing Figures

DEVELOPING UNIT FOR ELECTROPHOTOGRAPHY

BACKGROUND OF THE INVENTION

The invention relates to a developing unit which may be used in an electrostatic copying machine of the wet type, for example, and more particularly to a developing unit of the type including a developing electrode which has applied thereto a bias potential corresponding to the potential of the background of an electrostatic latent image.

As is well recognized, in an electrophotographic arrangement employing a photosensitive member which is formed of an organic, photoconductive semiconductor, wear of the photosensitive member may cause a variation in the residual potential on the background portion of the electrostatic latent image which corresponds to the background portion of an original being copied, thereby resulting in a background smearing. The background smearing may also be caused by the influence of the optical system or the developing solution used. A developing electrode is generally disposed in opposite relationship with the photosensitive member and has applied thereto a bias voltage which is usually of a constant magnitude. This reduces the biasing effect when a variation occurs in the residual potential of the background of the image as mentioned above.

To overcome this difficulty, there has previously been proposed (Japanese Patent Application No. 67714/1974) an automatic control technique to prevent the background smearing, in which a detecting electrode is located adjacent to that one end of the developing electrode which is first to be opposed by the photosensitive member, for detecting the potential of the background of the latent image in order to automatically establish a bias potential, applied to the developing electrode, which varies in accordance with the detected potential, thus enabling a high quality visual image to be obtained which is free from the background smearing.

When detecting the surface potential of the photosensitive member for the purpose mentioned, it is necessary to detect an electric field of an extremely low magnitude in the space surrounding the photosensitive member, so that a chopper circuit having a high gain must be provided, with the consequence that the detecting device becomes an expensive unit. The high gain is required of the detecting circuit because of the arrangement of the detecting electrode, which is either connected with the ground, maintained at a suitable potential, or secured to a shielding case through an insulating bracket.

The automatic control technique mentioned above is characterized by the detection of the surface potential within a developing solution having a relatively high conductivity in order to avoid the disadvantage mentioned in the immediately preceding paragraph. However, a mere provision of the detecting electrode in the solution is susceptible to the influence of the potential of the image region or other current noises, resulting in the generation of a large error.

SUMMARY OF THE INVENTION

Therefore, it is an object of the invention to provide a developing unit for electrophotography including a developing electrode which is located in opposite relationship with the photosensitive member and to which a bias potential is applied in accordance with the potential of a background portion of a latent image formed on the photosensitive member, by detecting the latter potential with a detecting electrode which is protected from the influence of noises by a protective electrode disposed in surrounding relationship with the detecting electrode so as to isolate it from external influences.

DETAILED DESCRIPTION OF EMBODIMENT

Figure 1:
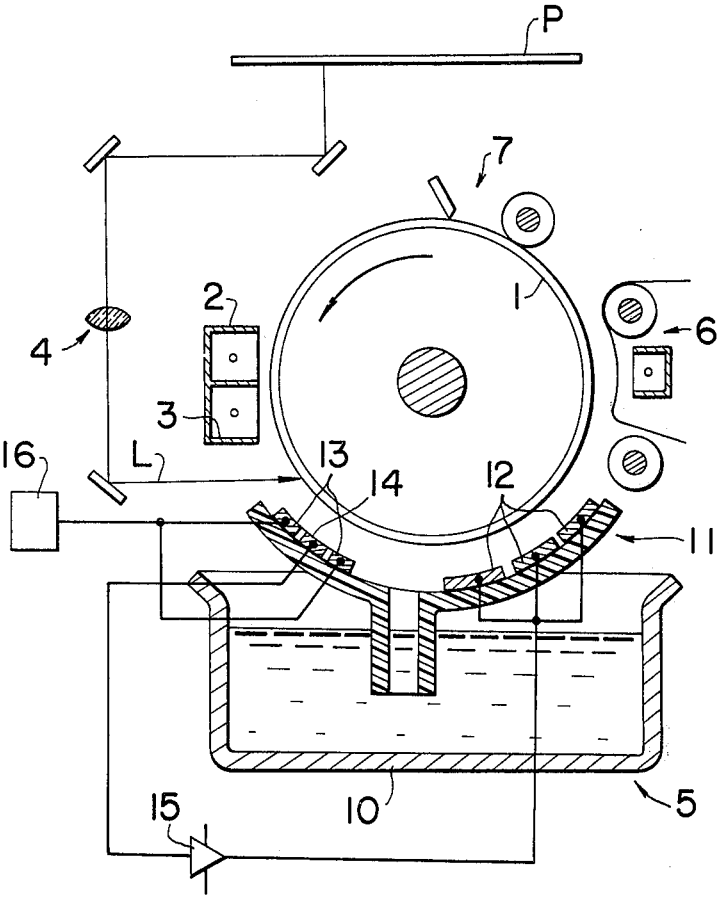
FIG. 1 is a schematic view of a developing unit for use with an electrophotographic copying machine which is constructed in accordance with one embodiment of the invention.

Referring to FIG. 1, there is shown a photosensitive member of a copying machine which is illustrated in the form of a drum 1. The drum 1 is adapted to rotate in the counterclockwise direction. Initially, any residual charge is removed from the drum surface by contact with a charge eliminating charger 2, and then the drum surface is uniformly charged by a primary charger 3. Subsequent to the charging step, the photosensitive member 1 is exposed to a ray L reflected from an original P, which is projected through an optical system 4. The charge on the drum surface is selectively reduced in accordance with the pattern of the ray L, thus forming an electrostatic latent image thereon. It is desirable that the latent image has a zero potential in a region which is exposed to a background of the original, but actually there remains some potential thereon, as mentioned above. The drum surface carrying the latent image is moved into opposing relationship with a developing unit 5 for conversion of the latent image into a visual image with a toner contained in a developing solution. Subsequently, the drum surface passes by a transfer unit 6 and a cleaning unit 7 to return to its initial position, completing one copying cycle.

The developing unit 5 comprises a vessel 10 for containing a quantity of a developing solution, a developing dishplate 11 which is disposed so as to cause the developing solution to flow thereacross, and a plurality of electrodes applied to the surface of the dishplate 11, including a developing electrode 12, a protective electrode 13 and a detecting electrode 14. In addition, the unit 5 includes a detection circuit 15, a power source 16 for feeding the protective electrode 13, a pump (not shown) and a squeeze roller 18.

Figure 2:
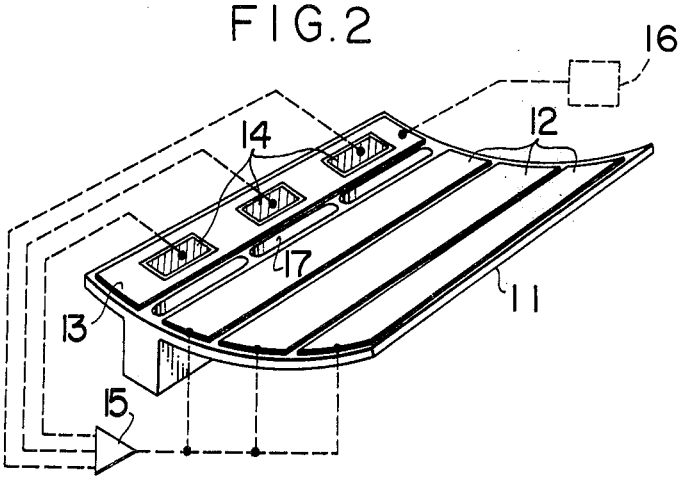
FIG. 2 is a fragmentary perspective view of the developing unit shown in FIG. 1.

Referring to FIG. 2, the developing dishplate 11, which is curved and formed of a material such as acrylic resin, is formed with a plurality of outlets 17, through which the developing solution emerges to form a moving layer thereon for contact with the drum surface to develop the latent image carried thereon. On the downstream side, a plurality of developing electrodes 12, which are three in the example shown, are applied to the surface of the dishplate 11, while the protective electrode 13, comprising an electrically conductive sheet of a suitable configuration (which is similar to that of the developing electrode 12 in the example shown) is, applied to the surface of the dishplate 11 on the upstream side thereof. A plurality of apertures, three in number in the example shown, are formed in the protective electrode, and fitted into these apertures are detecting electrodes 14 of an equal configuration.

Each detecting electrode 14 may be constructed in the conventional manner, and comprises an electrically conductive sheet of a suitable shape molded in an insulating material such as resin. The developing electrodes 12 are connected with the output of the detection circuit 15 while the detecting electrodes 14 are connected with a plurality of inputs thereto. The protective electrode 13 is connected with the power source 16. In the present embodiment, the source 16 has a 100 volt d.c. of the same polarity as that of the latent image, but it should be understood that any value of the potential, which does not interfere with the intended detecting and amplifying action of the circuit 15 and which prevents a contamination of the drum 1 and other electrodes from being caused by the toner, may be used. It has been proved through experiments by the inventors that the potential suitable to be applied to the protective electrode is in the range which covers the potential appearing on each detecting electrode, and preferably the instantaneous lowermost one thereof, in order to effectively cut off the influence of external electrical fields upon the detection electrodes.

The detection circuit 15 functions in a manner similar to that in Japanese patent application No. 67714/1974, by treating the minimum potential detected by the plurality of detecting electrodes as the background potential, and establishing a bias potential at its output which is slightly higher than the minimum potential. However, it is to be noted that any other bias control system may be used.

In this manner, the bias potential applied to the developing electrodes 12 is maintained at a value higher than the residual potential of the background in the latent image, thus assuring a developing of a high quality visual image. A feature of the invention resides in the simplification of the detection circuit. Specifically, the noises which may be produced around the detecting electrodes 14 are absorbed by the protective electrode 13, whereby the detecting electrodes can accurately detect the surface potential of the photosensitive member 1 without an increased gain in the detecting circuit.

An operation test has been conducted with the developing unit as described above. The photosensitive member was in the form of a selenium drum and exhibited a residual potential, in the background region, which was initially on the order of 20 to 30 volts, but which gradually increased to a value approaching 150 volts toward the end. The detection circuit 15 operated to provide a bias potential which was initially on the order of 50 to 60 volts and which increased to 180 volts toward the end, thus preventing a degradation in the image quality of the developed image despite the presence of a varying residual potential. When the protective electrode is disconnected from the power source and maintained at a floating potential, or when it is connected with the developing electrode to assume the same potential as the latter, there resulted a background smearing, an interruption in the image, or other degradations in the image quality depending on the optical density and the image occupancy of the original. While in the embodiment described above, the detecting electrodes have been fitted in apertures formed in the protective electrode, they can be located at positions adjacent to the marginal edge of the protective electrode with an equal effect.

What is claimed is:

1. In a developing unit for electrophotography comprising, a. means, having a surface movable in a predetermined direction past a developing station, for forming an electrostatic latent image on said surface, b. developing electrode means disposed at said station in opposite relationship with said surface, c. a plurality of detection electrodes each disposed in opposite relationship with said surface upstream of and adjacent said developing electrode means for sensing respective instantaneous potentials of portions of the electrostatic latent image on said surface opposing thereto so as to produce respective output signals, d. means responsive to said signals for applying a potential slightly higher than the lowermost one of said sensed potentials to said developing electrode means, and e. means for supplying a developing agent between said surface and developing electrode means, the improvement comprising, f. protective electrode means disposed close to said detection electrodes in opposite relationship with said surface, and g. means for applying a potential near those on said detection electrodes to said protective electrode means.

2. A developing unit according to claim 1 wherein said protective electrode means comprises an electrode element having a plurality of apertures formed therein and said detection electrodes are disposed within respective apertures.

3. A developing unit according to claim 1 wherein said last mentioned applying means comprises a d.c. voltage source.

4. A developing unit according to claim 1 wherein said last mentioned applying means is adapted to apply to said protective electrode means a potential corresponding to the instantaneous lowermost one of the potentials sensed by said detection electrode.

5. A developing unit according to claim 1 wherein said developing agent is of the liquid type.

* * * * *